United States Patent [19]

Herman

[11] 3,938,831

[45] Feb. 17, 1976

[54] METAL COVERED BOOKS

[75] Inventor: Walter H. Herman, Rose Valley, Pa.

[73] Assignee: Franklin Mint Corporation, Franklin Center, Pa.

[22] Filed: July 11, 1974

[21] Appl. No.: 487,483

[52] U.S. Cl. ..... 281/29; 16/150

[51] Int. Cl.[2] ..... B42D 3/00

[58] Field of Search ..... 281/29, 20, 36, 37, 15 R, 281/37.5, 34; 16/150

[56] References Cited

UNITED STATES PATENTS

| | | | |
|---|---|---|---|
| 481,015 | 8/1892 | Enos | 281/34 |
| 718,827 | 1/1903 | Deydier | 281/29 |
| 959,284 | 5/1910 | Andrews et al. | 281/29 |
| 1,890,139 | 12/1932 | Auburn | 281/37 X |
| 1,920,533 | 8/1933 | Strauss | 281/34 |
| 2,006,824 | 7/1935 | Cavalero | 281/36 |
| 2,177,879 | 10/1939 | Schade | 281/29 |
| 2,290,663 | 7/1942 | Wiser | 281/29 |
| 2,706,645 | 4/1955 | Pitner | 281/29 |
| 2,964,336 | 12/1960 | Akimoto | 281/29 |
| 3,518,143 | 6/1970 | Fuhr | 281/21 R X |

FOREIGN PATENTS OR APPLICATIONS

| | | | |
|---|---|---|---|
| 118,636 | 4/1947 | Sweden | 281/37.5 |

*Primary Examiner*—Jerome Schnall
*Attorney, Agent, or Firm*—Seidel, Gonda & Goldhammer

[57] ABSTRACT

A metal book binding comprising a metal cover laminated to hard covers and a spine cover of a conventional fabric-hinged, bound book with flexible mesh or woven wire metal hinges connecting the metal portions of the covers and spine to completely cover the book with metal, while not interferring with its normal hinge action.

4 Claims, 5 Drawing Figures

FIG. 5
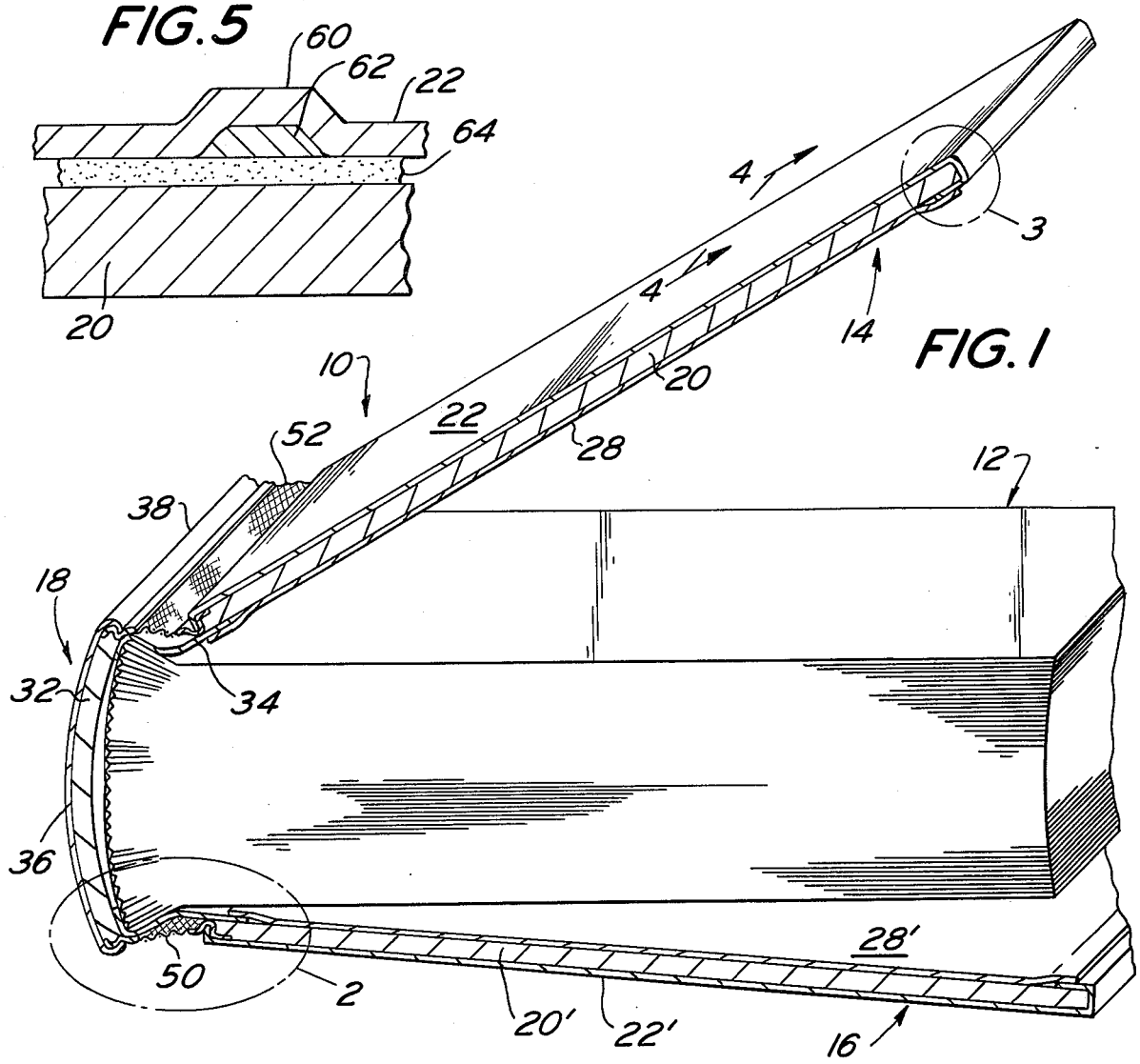
FIG. 1
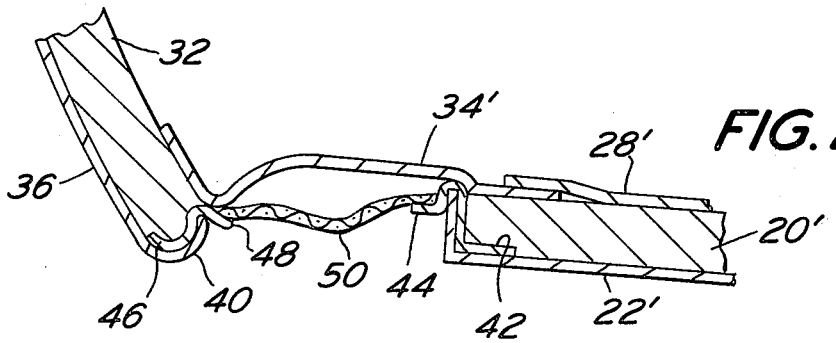
FIG. 2
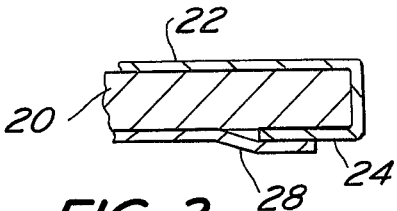
FIG. 3
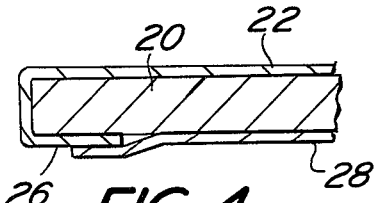
FIG. 4

METAL COVERED BOOKS

BACKGROUND OF THE INVENTION

Conventional metal covered books incorporate pin hinges. With such construction, the metal cover must be of heavy gauge and strength to be self-supporting. The metal covers cannot be laminated to the hard covers since it is necessary to allow for a slide action between the metal covers and the hard cover. The metal and hard covers are constrained to pivot about separate points when the book is open. The disadvantage of this conventional structure is that the metal must be thick and is prone to damage in its unsupported state. Also, because it must be slidably attached, the raw edges of the metal cannot be hidden by the inner trim sheet normally laminated to the inside of the hard cover.

The present invention relates to metal covered books. More particularly, the present invention is directed to a construction of a book which will allow a metal layer to be directly laminated to hard covers and spines so that the disadvantages of prior metal books construction can be avoided, while at the same time covering all exposed all exposed portions of the book cover with metal.

The invention allows full backing of the metal layer which is often decoratively embossed, by filling and attaching with epoxy or the like. This invention allows covering the raw edges of the metal layer wrapped on the hard covers by means of a trim sheet. Hence, no sliding is required between the metal layer and hard cover during opening and closing of the book.

The flexible portion of the cover which joins the rigid parts allows free opening and closing of the book covers on their normal fabric hinges without the dual pivot points and related strains normally associated with hinged metal covered books. By laminating the metal layer directly to the hard covers, it is no longer necessary to use metal sheets of heavy gauge. As a result, it becomes practical to use thin precious metals such as gold or silver as covering for the book. Furthermore, under the present invention, the metal layer is never in an unsupported state wherein it would easily be susceptible to damage.

Further advantages and benefits of the present invention will become apparent upon the reading of the description of the preferred embodiments of the invention taken in conjunction with the accompanying drawings.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 is a perspective view, partially in cross section, of a book embodying the features of my here-described invention.

FIG. 2 is an enlarged fragmentary cross-sectional bottom end view of the area 2 circumscribed in FIG. 1.

FIG. 3 is an enlarged fragmentary cross-sectional view of area 3 circumscribed in FIG. 1.

FIG. 4 is an enlarged cross-sectional view taken on line 4 — 4 of FIG. 1.

FIG. 5 is an enlarged cross-sectional view of an embossed section of a book embodying the features of my here-described invention.

DETAILED DESCRIPTION OF THE PREFERRED EMBODIMENT

Referring to the drawing, wherein like numerals indicate like elements, there is shown in FIG. 1 a sectional view of a book in accordance with this invention designated 10. The book 10 is composed generally of signatures 12 between covers 14 and 16 and spine 18. The front cover 14 of the book 10 is composed of an outer metal layer 22 laminated to a rigid core or cover 20. Back cover 16 is similarly composed of outer metal layer 22' laminated to a rigid core or cover 20'. The outer metal layers 22 and 22' can be of any practical thickness from foil-like thicknesses to much heavier construction such as 0.001 to 0.015 inches thick. The metal layers can be embossed or electro-formed, with heavy patterns being filled behind and fully supported by the rigid cover or core 20 or 20'. The metal layers can be etched or laminated or otherwise decorated if desired. Many metals can be utilized such as silver, gold, silver or gold-plated brass or steel, stainless steel, copper base metals, etc.

The rigid core or cover 20 can be of any normal material in construction like binders board, composition pressed board, wood, plastic, or the like. An adhesive is used to bond the metal layers 22, 22' to the rigid covers 20, 20', respectively, and can be of any suitable material such as epoxy.

The metal layers have flanges which overlap three edges of the associated hard cover. Thus, the metal layer 22 has an end flange 24 and a pair of side flanges 26 which overlap edges of hard cover 20. A trim sheet 28 of paper is adhesively bonded to the inner surface of hard cover 20 and overlies the flanges 24, 26. A similar construction is provided for cover 16 wherein the trim sheet is designated 28'.

Spine 18 is similarly composed of an outer sheet metal layer 36 and rigid core 32. Metal layer 36 may be of the same construction as layers 22 and 22'. Also, the rigid core 32 may be composed of an appropriate rigid material as per cores 20 and 20'. Flanges 38 and 40 on layer 36 overlie side edges of core 32.

Referring to FIG. 2, the core 32 of the spine 18 is connected to said covers 14, 16 by conventional fabric hinges 34, 34'. A free-flexing metal mesh or woven wire metal hinge 50 is metallurgically or adhesively bonded to exposed legs 44 and 48 protruding from metal clips 42 and 46, respectively. Clips 42 and 46 are embedded between the sheet metal layers 22' and 36, respectively, and their associated cores or covers and extend substantially throughout the entire height of the book. Hinge 52 extends between spine 18 and cover 14 while overlying cloth hinge 34. Hinge 50 extends between spine 18 and cover 16 while overlying cloth hinge 34'. Hinges 50 and 52 are identical and are mounted in the same manner.

Referring to FIG. 5, protrusion 60 is an embossment on a section of layer 22. The raised embossment 60 is supported from below by filler material 62 which can be any suitable material such as an epoxy, cement, adhesive, polymeric plastics, etc. As such, in most cases, material 62 can be the same material as the adhesive 64 which bonds the metal layer 22 to its associated rigid cover 20. Filler material 62 prevents embossment 60 from being deformed.

In a specific example of the invention, metal layers 22, 22' and 36 are embossed sterling silver layers about 0.008 inches thick. Hinges 50 and 52 as well as the clips 42, 46 are also sterling silver.

The present invention may be embodied in other specific forms without departing from the spirit or essential attributes thereof and, accordingly, reference should be made to the appended claims, rather than to the foregoing specification as indicating the scope of the invention.

What is claimed is:

1. A book comprised of rigid front and back covers connected to a spine, each cover being a laminate of an outer layer of metal and a hard non-metallic substrate, said metal layers of said front and rear covers extending around three edges of said hard non-metallic substrates, said spine being a laminate of an outer layer of metal and a hard non-metallic substrate, two fabric hinges, each fabric hinge being connected to one of said covers and to said spine, four elongated metal clips, each of said clips extending substantially throughout the entire height of said book, two of said clips being embedded in said spine between said layer of metal and said substrate and being exposed along both side edges of said spine, each of the other two of said clips being embedded in a different one of said covers between said layers of metal and said substrates and being exposed along the edge of each of said covers adjacent said spine, two hinges of flexible metal mesh overlying said fabric hinges, each said metal mesh hinge having an exposed outer surface of metal, each metal mesh hinge being connected along one side edge portion to the metal clip of one of said covers and along an opposite side edge portion to the metal clips of said spine to form metal mesh hinges between the spine and the covers whereby the entire outer surfaces of said covers, spine and hinges are metal.

2. A book according to claim , wherein the inside of each of said covers include a discrete trim sheet covering exposed edges of said metal layers and said hard non-metallic substrates.

3. A book in accordance with claim 1 wherein said metal layers are sterling silver.

4. A book in accordance with claim 1, wherein said layers of metal range from a foil-like thickness to 0.015 inches thick.

* * * * *